US006851357B1

(12) United States Patent
Martorella et al.

(10) Patent No.: US 6,851,357 B1
(45) **Date of Patent: *Feb. 8, 2005**

(54) MANUAL TRASH COMPACTOR

(75) Inventors: Rudolph Martorella, 2 Spruce St., Apt. 4A, Great Neck, NY (US) 11021; R Christopher Kidd, New York, NY (US)

(73) Assignee: Rudolph Martorella, Great Neck, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/130,726

(22) PCT Filed: Nov. 17, 2000

(86) PCT No.: PCT/US00/31703

§ 371 (c)(1),
(2), (4) Date: Oct. 4, 2002

(87) PCT Pub. No.: WO01/36299

PCT Pub. Date: May 25, 2001

Related U.S. Application Data

(63) Continuation of application No. 09/443,529, filed on Nov. 19, 1999, now Pat. No. 6,314,874.

(51) Int. Cl.[7] ..... B30B 1/00

(52) U.S. Cl. ..... 100/226; 100/246; 100/247; 100/255; 100/265; 100/295

(58) Field of Search ..... 100/280, 226, 100/246, 247, 255, 265, 295, 227, 229 R, 229 A, 233, 245, 293 OR, 283, 281

(56) References Cited

U.S. PATENT DOCUMENTS

| | | | | | |
|---|---|---|---|---|---|
| 1,557,547 | A | * | 10/1925 | Anderson | 100/243 |
| 2,423,209 | A | * | 7/1947 | Storey | 100/245 |
| 3,357,346 | A | * | 12/1967 | Bjorn-Craford | 100/226 |
| 3,411,722 | A | | 11/1968 | Webber | |
| 3,760,718 | A | * | 9/1973 | Adornetto | 100/227 |
| 3,850,094 | A | * | 11/1974 | Shontz | 100/219 |
| 3,919,932 | A | | 11/1975 | Basuino | |
| 3,946,662 | A | | 3/1976 | Ross, Jr. et al. | |
| 4,050,373 | A | | 9/1977 | Hellmann | |
| 4,128,055 | A | | 12/1978 | Hellmann | |
| 4,331,074 | A | | 5/1982 | Behman | |
| 4,658,720 | A | | 4/1987 | Massonnet | |
| 4,898,304 | A | * | 2/1990 | Bacon, Jr. | 222/82 |
| 5,024,374 | A | | 6/1991 | Ashby | |
| 5,072,852 | A | | 12/1991 | Smith et al. | |
| 5,560,289 | A | * | 10/1996 | Pernsteiner | 100/34 |
| 5,619,915 | A | * | 4/1997 | Wagner et al. | 100/98 R |
| 5,730,047 | A | * | 3/1998 | Lindsey | 100/90 |
| 5,845,567 | A | | 12/1998 | Fischer | |
| 6,314,874 | B1 | * | 11/2001 | Martorella | 100/226 |

FOREIGN PATENT DOCUMENTS

| | | |
|---|---|---|
| AT | 403 370 | 1/1998 |
| FR | 2 135 322 | 12/1972 |
| NL | 7903519 | 5/1979 |
| NL | 8 501 293 | 12/1986 |

* cited by examiner

*Primary Examiner*—Allen Ostrager
*Assistant Examiner*—Shelley Self
(74) *Attorney, Agent, or Firm*—Collard & Roe, P.C.

(57) ABSTRACT

A manual trash compactor comprising a can for holding the trash, a lever arm, at least one coupling arm coupling the lever arm to the can, and a plunging arm connected to the lever arm. There is also a compression plate connected to the plunging arm wherein this compression plate is designed to compress garbage inside the can. Disposed on top of the can is a collar and a cover coupled to the collar. The cover is coupled to the collar via a rotatable hinge. In a first embodiment of the invention, the can is disposed in a slidable tray so that the can, is able to be stored in a closed compartment. In addition, disposed adjacent to the can in the tray is a bin for storing other materials such as recyclable bottles. Coupled to either the can or the tray is a support means for supporting the can above a surface such as a kitchen floor. In a second embodiment of the invention the trash compactor is designed to be free standing wherein this trash compactor does not sit in a tray and also does not have a support means for supporting the can.

25 Claims, 9 Drawing Sheets

MANUAL TRASH COMPACTOR

CROSS REFERENCE TO RELATED APPLICATIONS

This application is being filed under 35 U.S.C. § 317 of PCT/US00/31703, filed on Nov. 17, 2000 wherein the applicant claims priority under 35 U.S.C. 371 from this application. Applicant claims priority under 35 U.S.C. § 120 of U.S. patent application Ser. No. 09/443,529, filed Nov. 19, 1999, now issued as U.S. Pat. No. 6,314,874.

BACKGROUND OF THE INVENTION

1. Field of the Invention

The invention relates to a manual trash compactor that comprises a can, and a means for the manual compaction of trash attached to the can.

2. The Prior Art

Austrian patent AT403 370B discloses a pressing mechanism for waste products such as packing material placed in container. This design differs from the present invention in that the lever arm is not directly or indirectly coupled to the can. In addition there is no rotatable coupling arm allowing the lever arm to correct its alignment during the compression of the trash.

Furthermore, there is no collar or hood attached to the can. In the present invention, a collar or hood having a cover is used to guide the plunging arm having the compression plate. In addition, in the present invention the compaction plate is removable while in Austrian Patent 403 370B the compression plate is not removable.

Other garbage compactors have also been known, for example, Netherlands Patent NL8501293 discloses a trash compactor that has an arm that is connected in a lower end of the can directly and not to a cover or hood as opposed to having the lever arm, and the coupling arm connected to a top portion of the can via a hood.

U.S. Pat. No. 5,730,047 discloses a portable refuse compacting container for compacting refuse in garbage bags or leaf bags. This design contains a lever arm, a plunging arm and a compaction arm. However, the compaction arm is coupled directly to the can without the use of an additional hinge. Thus, with '047 there is no additional action of the two arms, allowing the plunging arm to center itself with the compaction plate to get a direct compaction of trash when pressing down on the lever arm.

SUMMARY OF THE INVENTION

The invention relates to a manual trash compactor that is designed to allow a user to compress his or her trash inside a trash container. This manual trash compactor is designed to allow a user to compress his or her trash without the use of expensive and sometimes faulty machinery.

Thus, the invention relates to a manual trash compactor comprising a can for receiving trash, and a means for manually compacting trash housed in the can. This means is attached to the can. There is also means for supporting this can above a surface.

In this case, the means for manually compacting trash comprises a compression plate, a plunging arm connected to the compression plate, and a lever arm coupled to the plunging arm. There is also at least one connecting arm for coupling the lever arm to the can. More particularly, the lever arm, the plunging arm and the at least one connecting arm are coupled to each other via a series of hinges. This at least one connecting arm comprises a substantially vertical adjusting arm coupled to the lever arm via a hinge and a connecting arm coupled to the substantially vertical adjusting arm at a first end and coupled to the can at a second end.

The compression plate can also be removable from the plunging arm so that it can be more easily cleaned. There is also at least one clip for releasing or securing the compression plate to the plunging arm. In addition, there is a collar for fitting around the can wherein the collar is removably attached to the can.

Furthermore the compactor also comprises a cover, and a hinge connecting the cover to the collar. So that the cover does not flip open during the compacting of the trash, there is provided a locking means for clamping the cover to the collar. This locking means comprises a clip attached to the means for manually compacting trash and a flange attached to the collar. In operation, when the means for manually compacting the trash is in a zone for compressing the trash, the clip attaches to the flange to lock the cover to the collar.

This trash compactor can be stored in a tray adjacent to a bin. This tray can be used to slide the compactor and the can in and out of a storage compartment. In addition, coupled to the can is a means for supporting the can above a surface such as a kitchen floor.

In a second embodiment of the invention, there is shown a free standing trash compactor wherein this free standing trash compactor does not contain any means for supporting the can above a surface. In addition, this free standing trash compactor is designed to have a can height that is higher than the trash compactor disposed on the tray. Furthermore, the cover on this trash compactor is secured to the collar via a hinge extending along a shortened side of the collar, opposite an open end of the lever arm. With this design, once a user presses down on the lever arm to compact the trash, the collar is held down via the force of the user and would not need to have a clamping means to clamp the cover to the collar.

In a third embodiment of the invention, there is a free standing trash compactor that has only two rotating arms for driving the trash into the can. With this design there are fewer moving parts so that there is a cost savings from this design.

BRIEF DESCRIPTION OF THE DRAWINGS

Other objects and features of the present invention will become apparent from the following detailed description considered in connection with the accompanying drawings which disclose three embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
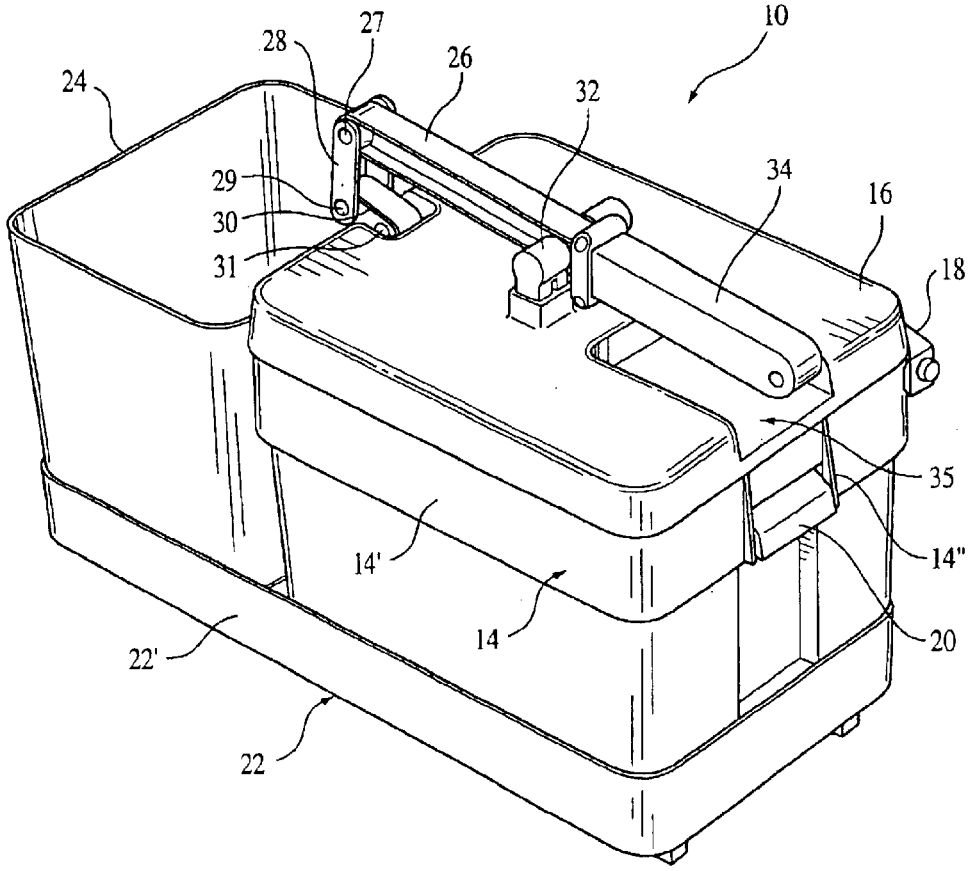
FIG. 1 shows a perspective view of the first embodiment of the invention showing the invention from a front-top-right viewpoint.

FIG. 1 refers to a perspective view of the first embodiment of the invention which is manual trash compactor 10 for storable trash cans. With this view, there is shown a garbage can 12, while attached to garbage can 12 is a collar or hood 14 which connects to a cover portion 16. Collar 14 contains a peripherally extending rim 14' that is designed to wrap around garbage can 12. Collar 14 rests upon garbage can 12, while cover 16 is secured to collar 14 via a hinge 18.

Collar 14 contains a flange 14' that extends around can 12. There is an opening 14" in collar 14 that allows a collapsible flange 20, attached to can 12, to enter therethrough. Collapsible flange 20 collapses down when collar 14 is placed over can 12 and then snaps out through opening 14' when collar 14 is secured on can 12. Collar 14 is also designed so that a plastic bag (not shown) can be placed in can 12, over a series of top edges of can 12. In this way, once collar 14 is secured over can 12, it locks the plastic bag in place until collar 14 is removed from can 12. Can 12 rests in a tray 22 and is positioned adjacent to a bin 24. Bin 24 can be used to receive recyclable materials such as cans, bottles etc.

Tray 22 is designed as a slidable tray that allows can 12 to be pulled out of a cabinet or closed space on a track (not shown). This tray 22, is designed to be substantially rectangular in shape with side flanges 22' extending up from a bottom plate 22". These side flanges 22' are designed to hold can 12 and bin 24 together on one tray.

In a top region of collar 14 is a compacting means wherein there is shown a lever arm 26, a substantially vertical adjusting arm 28 connected to lever arm 26, and a connecting arm 30 connected to vertical adjusting arm 28. Each of these arms 26, 28, and 30 is connected to each other via a hinge. For example a lever hinge 27 connects lever arm 26 to vertical adjusting arm 28 while an intermediate hinge 29 connects vertical adjusting arm 28 to connecting arm 30. Finally, a can hinge 31 connects arm 30 to cover 16. With these three arms all joined by hinges, the crushing arm mechanism allows a user to have enough leverage to compress the garbage without the use of complicated machinery.

Figure 2:
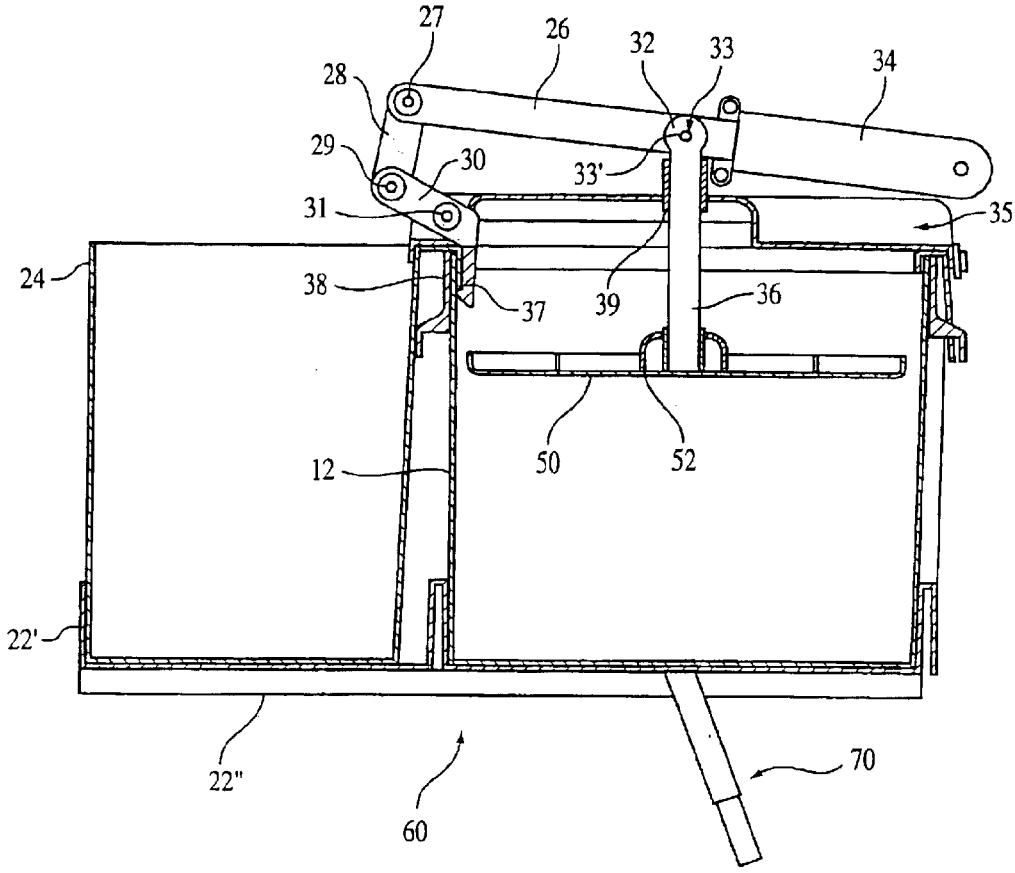
FIG. 2 shows a side cross-sectional view of the first embodiment of the invention.

Lever arm 26 connects to a plunging arm connecting region 32 of plunging arm 36 via a hinge 33 (See FIG. 2). There is also disposed on lever arm 26 a handle 34 that is optionally slidable to give a user more leverage when compressing his or her garbage in can 12. As lever arm 26 is compressed down, it moves into a recessed region 35 within collar 14. Recessed region 35 is a region designed to allow lever arm 26 and handle 34 to fit down into cover 16 giving lever arm 26 more room to rotate.

As shown in FIG. 2, there is a cross sectional view of the first embodiment of compactor 10 wherein this view shows the connection between lever arm 26 and plunging arm 36. Here, connecting region 32 formed by plunging arm 36, lever arm 26, and a tie rod 33' all connect around hinge 33 which allows lever arm 26 to drive plunging arm 36 down into can 12.

In addition, as lever arm 26 is being driven down (See FIG. 7) clip 37, which is attached to connecting arm 30 rotates into flange 38 disposed inside of can 12. Flange 38 is essentially a portion of collar 14 disposed on an inside region of can 12. Here, flange 38 is designed to lock with clip 37 so that it clamps the crushing arm mechanism to collar 14.

In addition, as shown in FIG. 2, there are also guides 39 that are designed to guide plunging arm 36 into the can. These guides 39 are designed to guide plunging arm 36 in a straight line so that it drives into the garbage in can 12.

Attached to plunging arm 36, is a compression plate 50 that contains a support flange 52 that wraps around compression plate 50. Here, support flange 52 is designed to provide lateral stability to compression plate 50 so that compression plate 50 does not alter its orientation while compressing garbage in can 12.

Figure 3:
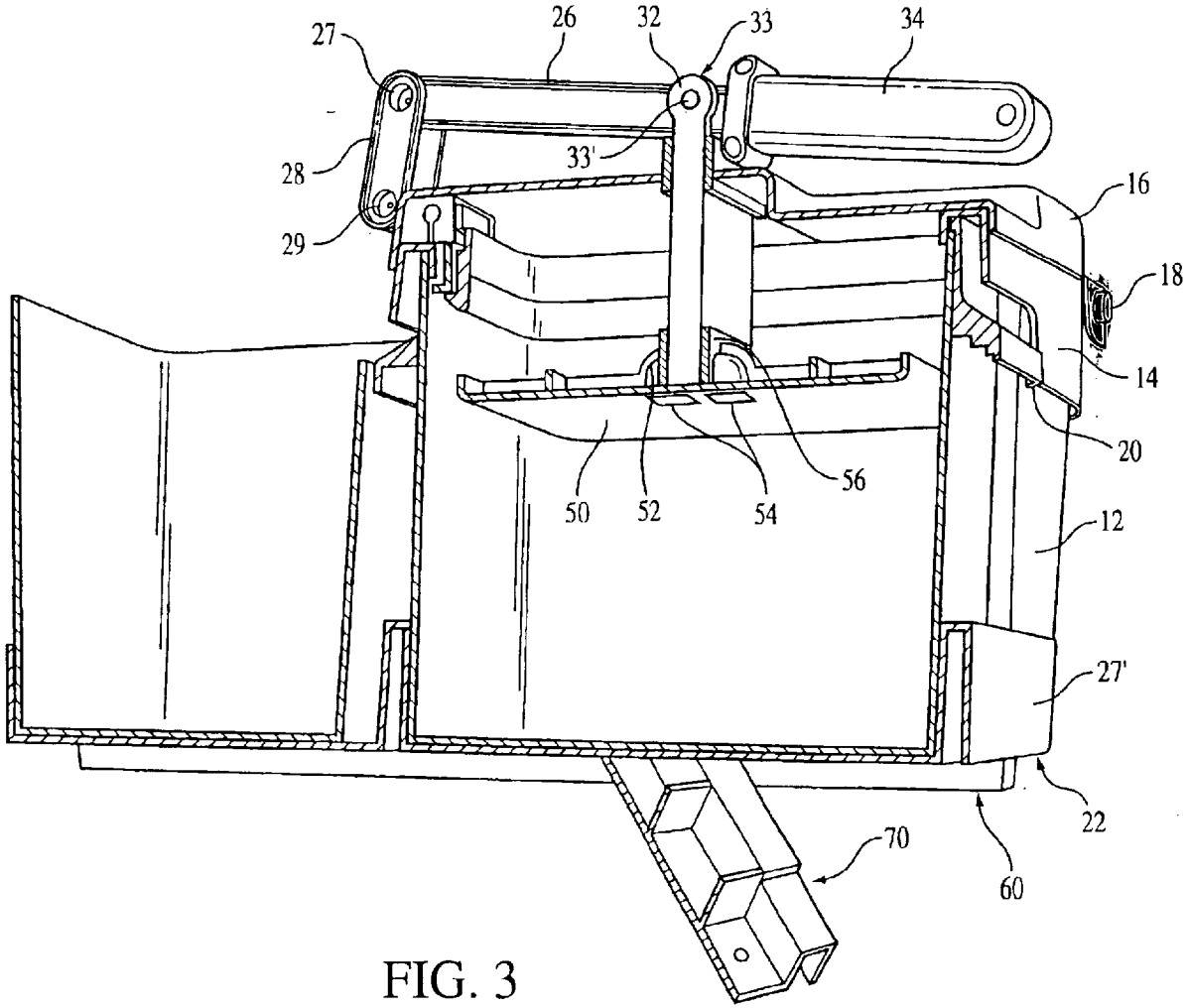
FIG. 3 shows a perspective cross sectional view of the first embodiment of the invention.

Compression plate 50 can be removed from plunging arm 36 so that compression plate 50 can be easily cleaned. As shown in FIG. 3, compression plate 50 contains a series of holes 54 that are designed to receive a series of clips 56 that extend through holes 54. With this design, a user can pinch clips 56 so that when these clips 56 are pinched, compression plate 50 can be easily removed from plunging arm 36. Once compression plate 50 has been cleaned, it can then be reinserted onto plunging arm 36 by pinching clips 56 and then inserting plate 50 onto plunging arm 36.

Figure 4:
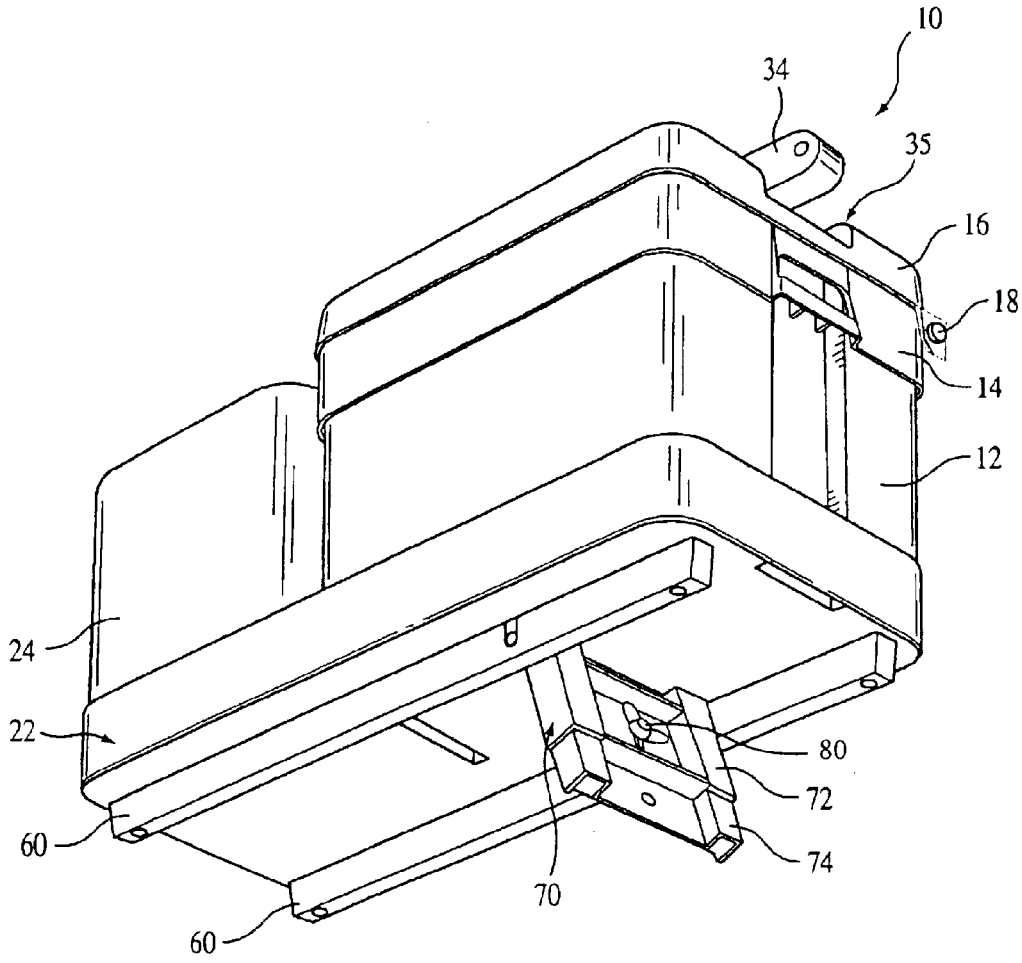
FIG. 4 shows a perspective view of the first embodiment of the invention showing the invention from a front-bottom-right viewpoint.

FIG. 4 shows a perspective view of manual compactor 10 wherein there is shown a series of guide rails 60 that are attached to tray 24. Guide rails 60 are designed to facilitate the sliding of tray 24 in and out of a storage compartment. Extending out from tray 24 is an adjustable support leg 70 that contains a top section 72 and a bottom section 74. Bottom section 74 can be semi-permanently extended out from top section 72 so as to fit the appropriate length of support from the bottom of tray 24 to a floor. Support leg 70 can be either folded down or folded up depending on whether a user is storing compactor 10 or pulling compactor 10 out of its storage compartment for use.

This support leg 70 is adjustable in length via a wing nut 80 that is attached to a bolt (not shown). Essentially an inside region of top section 72 and bottom section 74 each have a sawtooth region (not shown) where these sections meet. As wing nut 80 is clamped down, these saw-toothed regions match together to fix top section 72 and bottom section 74 in place.

With this design, compactor 10 can be supported in a stable position while extended out from its storage compartment. In this way, as lever arm 26 is pushed down (See FIG. 7), there is additional support from support leg 70 which counteracts the downward pressure exerted from lever arm 26.

Figure 5:
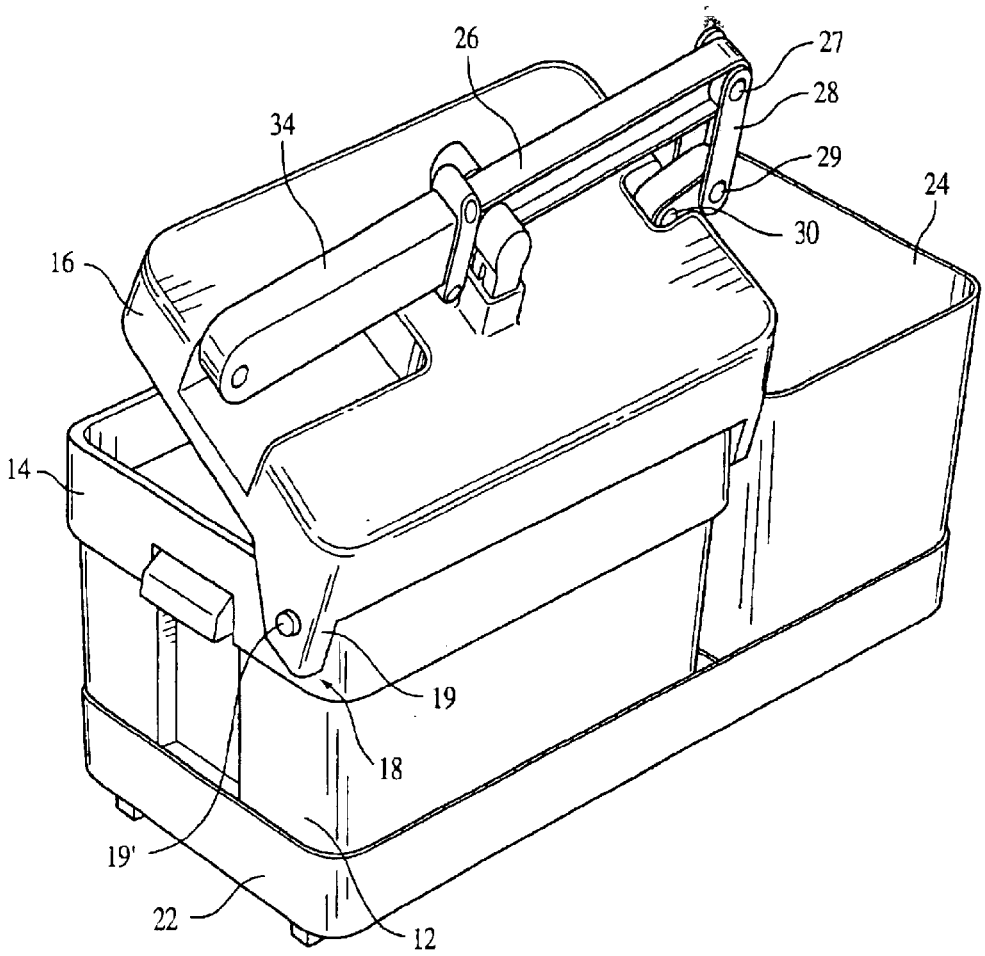
FIG. 5 shows a perspective view of the first embodiment of the invention showing the invention from a back-top-right viewpoint.

FIG. 5 shows a perspective view of compactor 10, wherein from this view, there is shown a hinge 18 that comprises a hinge flange 19, connected to collar 14, and a hinge plug 19' that extends through hinge flange 19. Hinge 18 allows top cover 16 to fold up from collar 14. In this way, top cover will open up to allow an individual to insert garbage into can 12. So that top cover 16 does not flip open during the compacting stage, clip 37 (See FIG. 2) is latched to flange 38 during this process. In addition, with this design, cover 16 can be designed to open from a reverse position. For example as shown in FIG. 5, this design is for a compartment having a door with a hinge on its left side. However, if an individual wanted to place this compactor 10 inside a door having a hinge on its right-hand side then cover 16 can be molded to have hinge flanges 19 on the opposite side. Collar 14 could then be rotated 180 degrees so that cover 16 could be attached on the opposite side.

Can 12, collar 14 and cover 16 are all assembled as interconnected components that are removable from each other. With this first embodiment, as shown in FIGS. 1–5 collar 14 fits over can 12 and is secured to can 12 via flange 20 that fits through an opening 14". Once flange 20 snaps out from opening 14" it fastens collar 14 to can 12. Since can 12 has two flanges 20 on opposite ends of can 12, these flanges allow collar 14 to be attached securely to can 12. In addition, cover 16 is secured on at least one edge of collar 14 via a hinge 18. So that cover 16 is securely fastened to collar 14, clip 37 is provided to stop hinge 18 from rotating, thus keeping cover 16 from rotating away from collar 14. Thus, with this design, all of these components, can 12, collar 14, and cover 16 can either be detached from each other, or securely fastened to each other depending on the user's needs.

Figure 6:
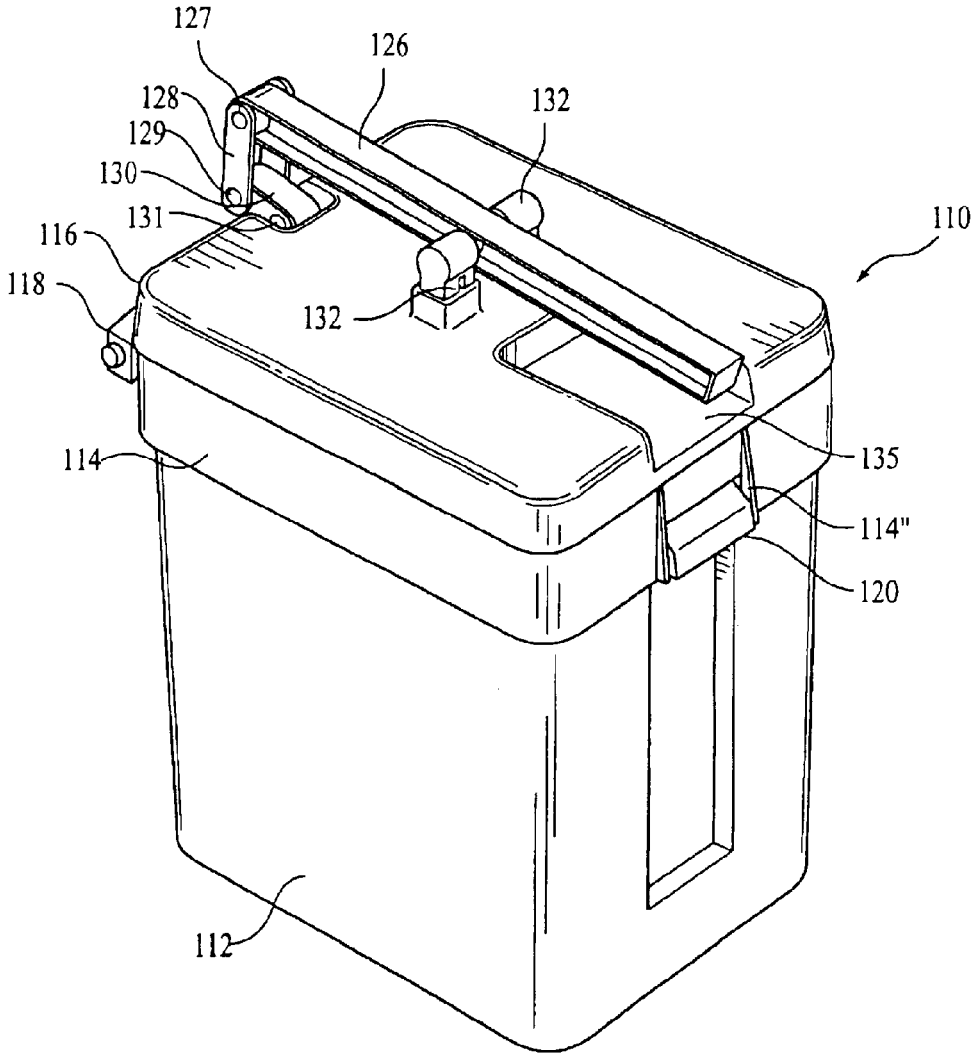
FIG. 6 shows a perspective view of the second embodiment of the invention.

FIG. 6 shows a perspective view of the second embodiment of the invention. Here, this design differs from the first embodiment because can 112 has a greater height than can 12 (FIG. 1) and this can 112 no longer sits in tray 22. This second embodiment 110 is essentially a free standing version of compactor 10. Here, collar 114 secures over can 112, while cover 116 is hingeably attached to collar 114. With this design, hinge 118 differs in placement from hinge 18. Hinge 118 is secured to a shorter side of rectangular shaped can 112. Hinge 118 is designed to allow cover 116 to flip up off of collar 114 to allow a user to place garbage inside of can 112.

Cover 116 is automatically secured down to collar 114 because of the momentary force exerted on lever arm 126 in the non-hinged region of cover 116 which is opposite hinge 118. Therefore, as shown in FIG. 7, no clips are necessary to secure cover 116 to collar 114.

Figure 7:
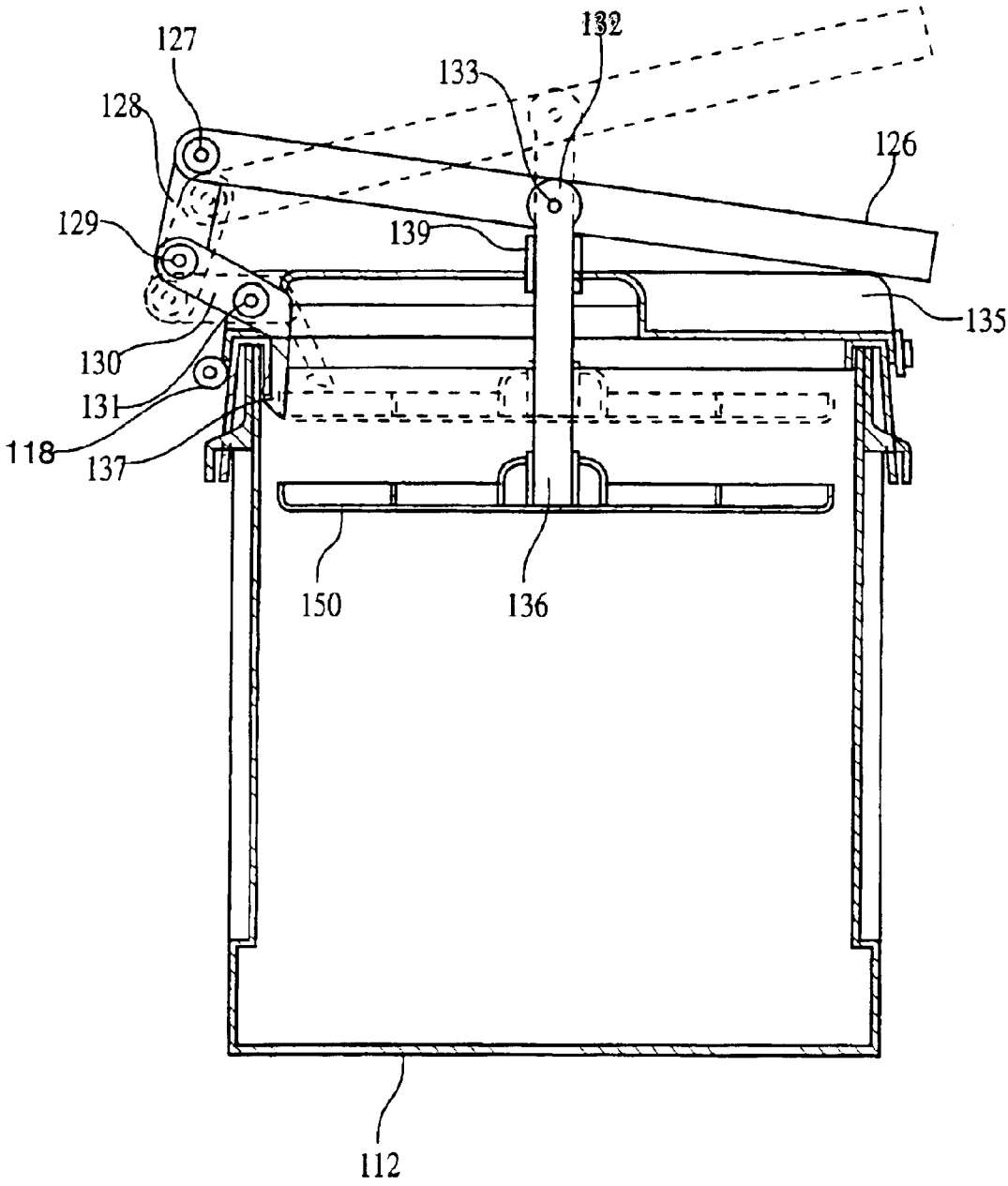
FIG. 7 shows a cross-sectional view of the second embodiment invention shown in FIG. 6.

FIG. 7 shows the movement of lever arm 126 as a user compacts garbage. So that a user would have leverage in compacting the garbage, the user would grab into an end of lever arm 126, opposite hinge 127, and press down on lever arm 126. This downward force causes lever arm 126 to rotate about hinge 127. Hinge 127 connects lever arm 126 to substantially vertical adjusting arm 128. Adjusting arm 128 also rotates about hinge 130 so that as lever arm 126 rotates clockwise and down during compaction of the garbage, adjusting arm 128 also rotates clockwise. Adjusting arm 128 also connects to connecting arm 130 at hinge 129 wherein connecting arm 130 then connects to cover 116 on collar 114 via hinge 131. With this design there are three arms 126, 128 and 130 that rotate and adjust simultaneously while the garbage is being compacted.

Because arms 126, 128, and 130 and plunging arm 136 are all adjusting simultaneously, about hinges 127, 129, 131, and 133, plunging arm 136 can maintain a straight line path into can 112. This straight line path is controlled by guides 139 which force plunging arm 136 to travel in this straight line path. In addition, so that plunging arm 136 does not become impinged on guides 139, arms 128 and 130 rotate in a clockwise manner as lever arm 126 rotates down. The rotation of arms 128 and 130 allow lever arm 126 to move axially as well as radially about hinge 127. This axial movement of lever arm 126 results in a substantially vertical downward force on plunging arm 136 which also results in a straight line path. Ultimately this straight line path is important because compression plate 150 retains its orientation as substantially parallel with an opposing surface of can 112. This orientation of compression plate 150 results in a substantially uniform compression of garbage inside can 112.

Figure 8:
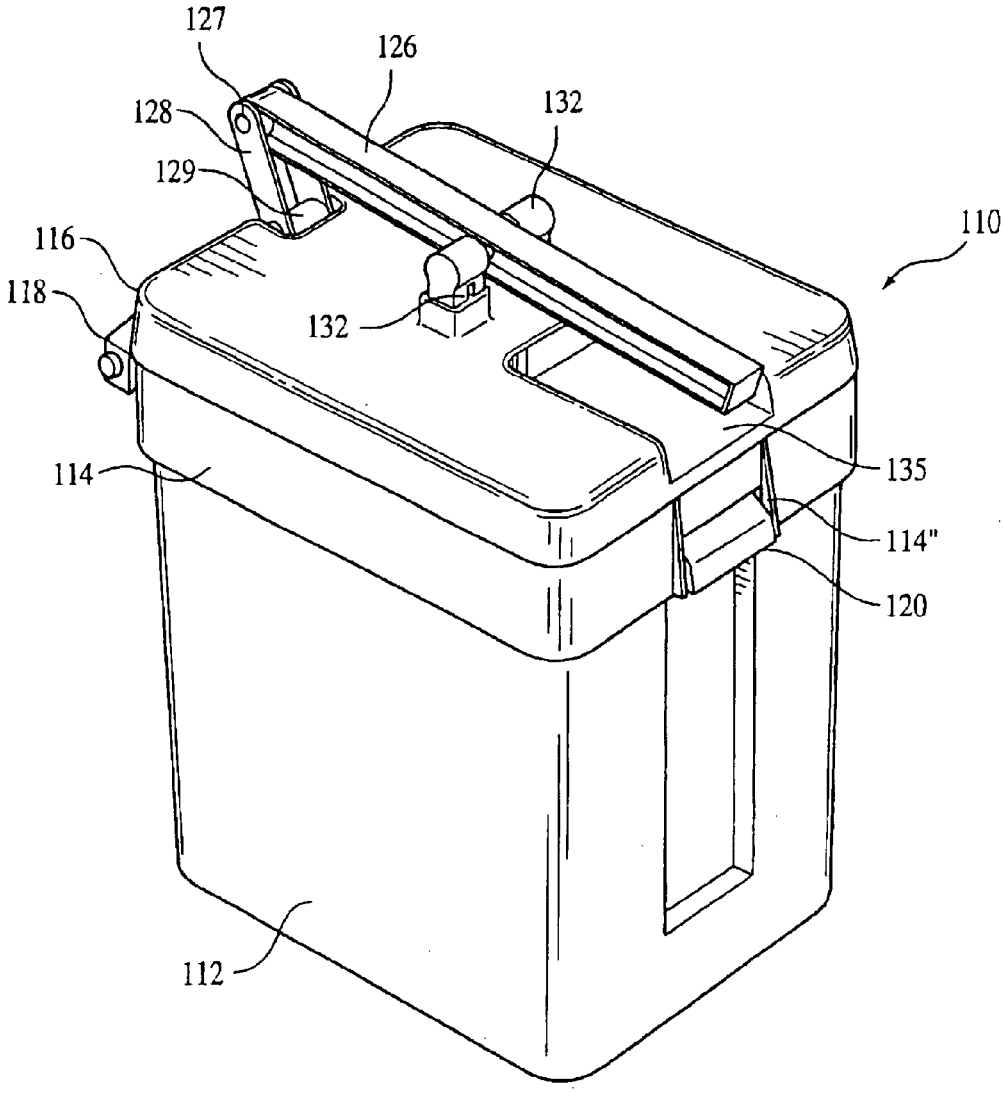
FIG. 8 shows a perspective view of the third embodiment of the invention.
Figure 9:
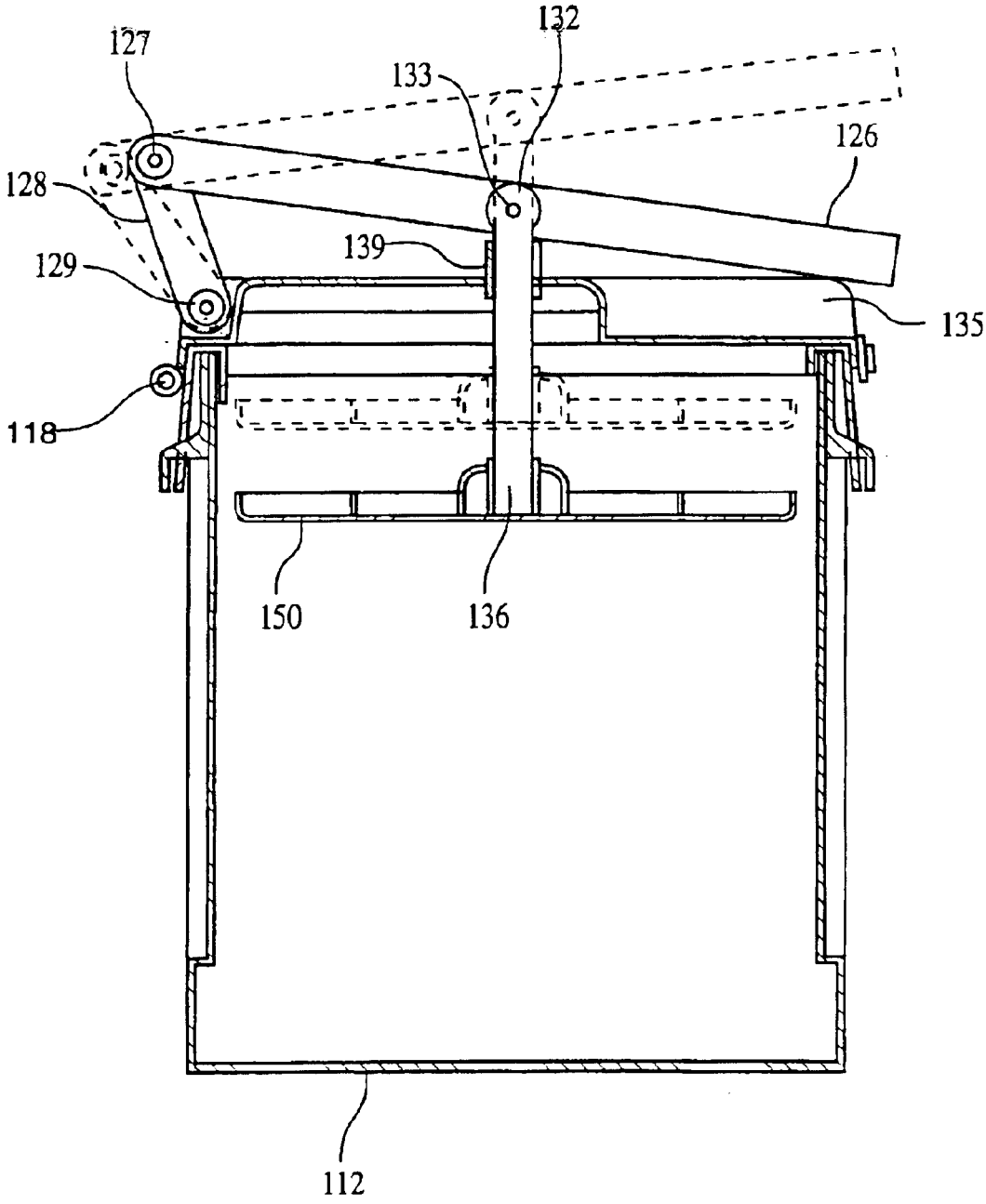
FIG. 9 shows a cross-sectional view of the third embodiment of the invention shown in FIG. 9.

FIG. 8 shows a third embodiment of the present invention. This embodiment is similar to the embodiment shown in FIG. 6, however, in this embodiment thee are only two lever arms 128 and 126 which are used. As shown in FIG. 9, lever arm 126 connects to vertical adjusting arm 128 via hinge 127. Vertical adjusting arm 128 connects to cover 116 via hinge 129. As shown, there is also no clip 137 that attaches an adjusting arm to collar 114 to secure cover 116 to collar 114. Rather, with this design, the cover is secured at one end via a hinge 118 that is positioned along a short edge of can 112 while the moment force on lever arm 126 holds the opposite edge of cover 116 down.

As shown in FIG. 9, the movement of lever arm 126 causes the downward movement of plunger 136. In addition, this movement down of lever arm 126 can also cause the rotation of adjusting arm 128 in a clockwise manner. Because adjusting arm 128 rotates in a clockwise manner, lever arm 126 moves axially as it rotates about hinge 127. This axial movement of lever arm 126 keeps the force created by pressing down on lever arm 126 substantially vertical which allows plunging arm 136 to travel in a substantially straight line into can 112.

With this design, the contents inside can 112 can still be crushed without using the additional arm 130 shown in FIGS. 1–7 which leads to an additional cost savings because fewer parts are used.

Accordingly, while three embodiments of the present invention have been shown and described, it is to be understood that many changes and modifications may be made thereunto without departing from the spirit and scope of the invention as defined in the appended claims.

What is claimed is:

1. A manual trash compactor comprising:

a) a can for receiving trash;

b) a compression plate;

c) a plunging arm rotatably connected to said compression plate;

d) a lever arm rotatably coupled to said plunging arm;

e) a collar coupled to a top region of said can;

f) a cover coupled to said collar wherein said cover contains a guiding flange for guiding said plunging arm in a substantially vertical position;

g) at least one connecting arm rotatably coupled to said collar for rotatably coupling said lever arm to said collar can; and h) at least one hinge for coupling said at least one connecting arm to said cover.

2. The manual trash compactor as in claim 1, wherein said lever arm, and said plunging arm are rotatably coupled together via a plunging hinge and said lever arm and said at least one connecting arm are rotatably coupled to each other via a lever hinge.

3. The manual trash compactor as in claim 1, wherein said at least one connecting arm comprises a substantially vertical adjusting arm coupled to said lever arm via a lever hinge and a second connecting arm coupled to said substantially vertical adjusting arm at a first and via an intermediate hinge and coupled to said can via a can hinge at a second end.

4. The manual trash compactor as in claim 1, wherein said compression plate is removable from said plunging arm.

5. The manual trash compactor as in claim 4, further comprising at least one clip for releasing or securing said compression plate to said plunging arm.

6. The manual trash compactor as in claim 1, further comprising a locking means for clamping said cover to said collar when said compression plate is compacting the trash.

7. The manual trash compactor as in claim 6, wherein said locking means comprises a locking clip attached to said connecting arm and a flange attached to said collar wherein when said lever arm is in a zone for compressing said trash, said locking clip clips on to said flange to lock said cover to said collar.

8. A manual trash compactor which can be placed on a garbage can housing trash, the compactor comprising:

a hood having an open and that can be disposed over an open end of the garbage can;

at least one lever arm rotatably coupled to said hood;

at least one plunging arm rotatably coupled to said at least one lever arm; and at least one coupling arm rotatably coupled to said at least one lever arm at a first end and rotatably coupled to said hood at an opposite end; and at least one compression plate coupled to said plunging arm wherein the trash is compacted in the can when said lever arm is pushed down.

9. The manual trash compactor as in claim 8, further comprising at least one coupling arm coupling said lever arm to said can.

10. The manual trash compactor as in claim 9, further comprising at least one additional coupling arm coupling said at least one coupling arm to said can.

11. The manual trash compactor as in claim 9, further comprising a cover coupled to the can wherein said at least one coupling arm is coupled to said cover.

12. The manual trash compactor as in claim 11, wherein said hood is in the form of a collar coupled to said can wherein said collar is coupled to said cover.

13. The manual trash compactor as in claim 12, wherein said collar is coupled to said cover via a side hinge.

14. The manual trash compactor as in claim 12, wherein said collar is coupled to said can via a releasable catch.

15. The manual trash compactor as in claim 12, wherein said collar has a flange that extends around an inner region of the can.

16. The manual trash compactor as in claim 15, further comprising a locking clip, attached to said cover, wherein said locking clip contacts said flange to secure said cover to said collar when said compression plate is in a region for compressing the trash.

17. The manual trash compactor as in claim 8, wherein said at least one compaction plate is removable from said plunging arm.

18. The manual trash compactor as in claim 8, further comprising an adjustable support leg coupled to said can for supporting the can above a surface.

19. The manual trash compactor as in claim 8, further comprising a tray for housing the can.

20. The manual trash compactor as in claim 18, further comprising a support log coupled to said tray for supporting said tray above a surface.

21. The manual trash compactor as in claim 20, wherein said support leg is adjustable in length.

22. A manual trash compactor for fitting over a can, the compactor comprising:

a can;

at least one adjusting arm rotatably coupled to a top portion of the can via a hinge connection;

at least one lever arm rotatably coupled to said at least one adjusting arm;

at least one plunging arm coupled to said at least one lever arm; and at least one compression plate coupled to said plunging arm wherein said trash is compacted in the can when said lever arm is pushed down.

23. The manual trash compactor as in claim 22, further comprising a cover coupled to a top portion of the can wherein said at least one adjusting arm is coupled to said cover.

24. The manual trash compactor as in claim 23, further comprising a first hinge rotatably coupling said at least one adjusting arm to said at least one lever arm and a second hinge rotatably coupling said at least one adjusting arm to said can.

25. The manual trash compactor as in claim 22 wherein said at least one adjusting arm is substantially straight.

* * * * *